US005081738A

United States Patent [19]

Schiller et al.

[11] Patent Number: 5,081,738

[45] Date of Patent: Jan. 21, 1992

[54] MOTOR SPEED SIGNAL TRANSMITTER FOR A VACUUM CLEANER

[75] Inventors: Mikael A. W. Schiller, Malmö ; Per A. Melin, Upplands Väsby; Leif E. Edlund, Upsala, all of Sweden

[73] Assignee: Aktiebolaget Electrolux, Stockholm, Sweden

[21] Appl. No.: 582,947

[22] PCT Filed: Jan. 24, 1990

[86] PCT No.: PCT/SE90/00050

§ 371 Date: Oct. 11, 1990

§ 102(e) Date: Oct. 11, 1990

[87] PCT Pub. No.: WO90/09139

PCT Pub. Date: Aug. 23, 1990

[30] Foreign Application Priority Data

Feb. 14, 1989 [SE] Sweden ..... 8900504

[51] Int. Cl.[5] ..... A47L 9/28

[52] U.S. Cl. ..... 15/339; 15/412

[58] Field of Search ..... 15/319, 339, 412

[56] References Cited

U.S. PATENT DOCUMENTS 4,611,365 9/1986 Komatsu et al. ..... 13/339

4,654,924 4/1987 Getz et al. ..... 15/339 X

*Primary Examiner*—Chris K. Moore

*Attorney, Agent, or Firm*—Pearne, Gordon, McCoy & Granger

[57] ABSTRACT

A vacuum cleaner (10) is connected to a dust collecting nozzle (14) via a hose (11) provided with a hose handle (12). The vacuum cleaner comprises a suction fan (17), driven by an electric motor (18), and an electric control device (20) for the control and/or setting of the motor speed for different operating modes. The control device (20) is operated by an operating device (21) disposed on the hose handle (12) and being electrically connected to the control device (20) via two coils, coupled to each other, a primary coil (28) of which being disposed in the vacuum cleaner and a secondary coil ( 26) being disposed in the hose. A conversion device (31, 34, 36, 38), disposed in the vacuum cleaner, is provided to sense and convert the states of a secondary circuit (25, 26), having as a part the secondary coil (26), said states corresponding to different operating modes and being caused by said operating device. The operating device (21) has a design so as to operate, via a logic device (23), the secondary circuit (25, 26) to take two separate electrical states. In dependence on the operating mode set by the operating device (21) the logic device (23) operates to keep the secondary circuit (25, 26) in one state during a time which is dependent on the operating mode set.

9 Claims, 4 Drawing Sheets

MOTOR SPEED SIGNAL TRANSMITTER FOR A VACUUM CLEANER

The present invention relates to a device for detecting user selected operating mode settings for a vacuum cleaner, and for generating and transmitting corresponding control signals to a motor speed controller. More particularly, the invention relates to the use of such a device in a canister type vacuum cleaner having the operating mode controls disposed on a hose-mounted handle.

In a known vacuum cleaner, presently on the market, the coil and capacitor of the primary circuit are supplied by an oscillator of a frequency coinciding with the resonant frequency of the circuit, maximizing the current in said circuit. In the secondary circuit a load is connected which comprises a number of resistors, corresponding to different operating modes, each of which is connected in series with a manually operable contact. A selected contact brings the desired resistor to be connected in parallel to a series circuit formed by a secondary coil and a capacitor. In this way the primary resonant circuit can be loaded to various degrees, causing the voltage across the primary circuit capacitor to take different identifiable levels. For natural reasons, the number of levels is limited by the fact that said levels have to be identified in a safe way. In practice, problems may arise at a number of levels exceeding four. U.S. Pat. Nos. 4,654,924 and 4,419,783 disclose prior art means for the exchange of information and/or communication of control signals between the vacuum cleaner hose and the body of the vacuum cleaner.

The object of the invention is to eliminate the limitation as to the number of operating levels in a vacuum cleaner of the kind referred to and to provide an arrangement for the detection of a user selected setting of a manual operating member disposed on a hose-mounted handle, each of an arbitrary number of settings having a designated operating mode and a corresponding suction fan motor speed, and for transmitting a corresponding signal to a motor speed controller.

The invention will now be described in detail in connection with a few embodiments with reference to the enclosed drawings, in which:

FIG. 1, schematically shows a vacuum cleaner having a hose and a dust collecting nozzle connected to it;

Figure 8:
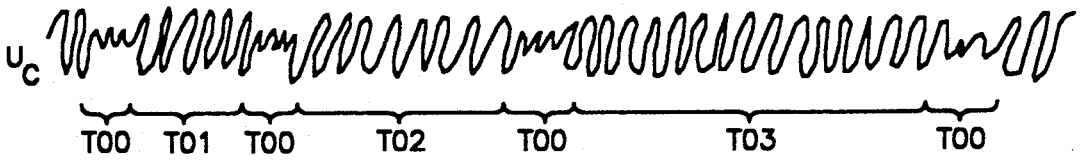
Figure 7:
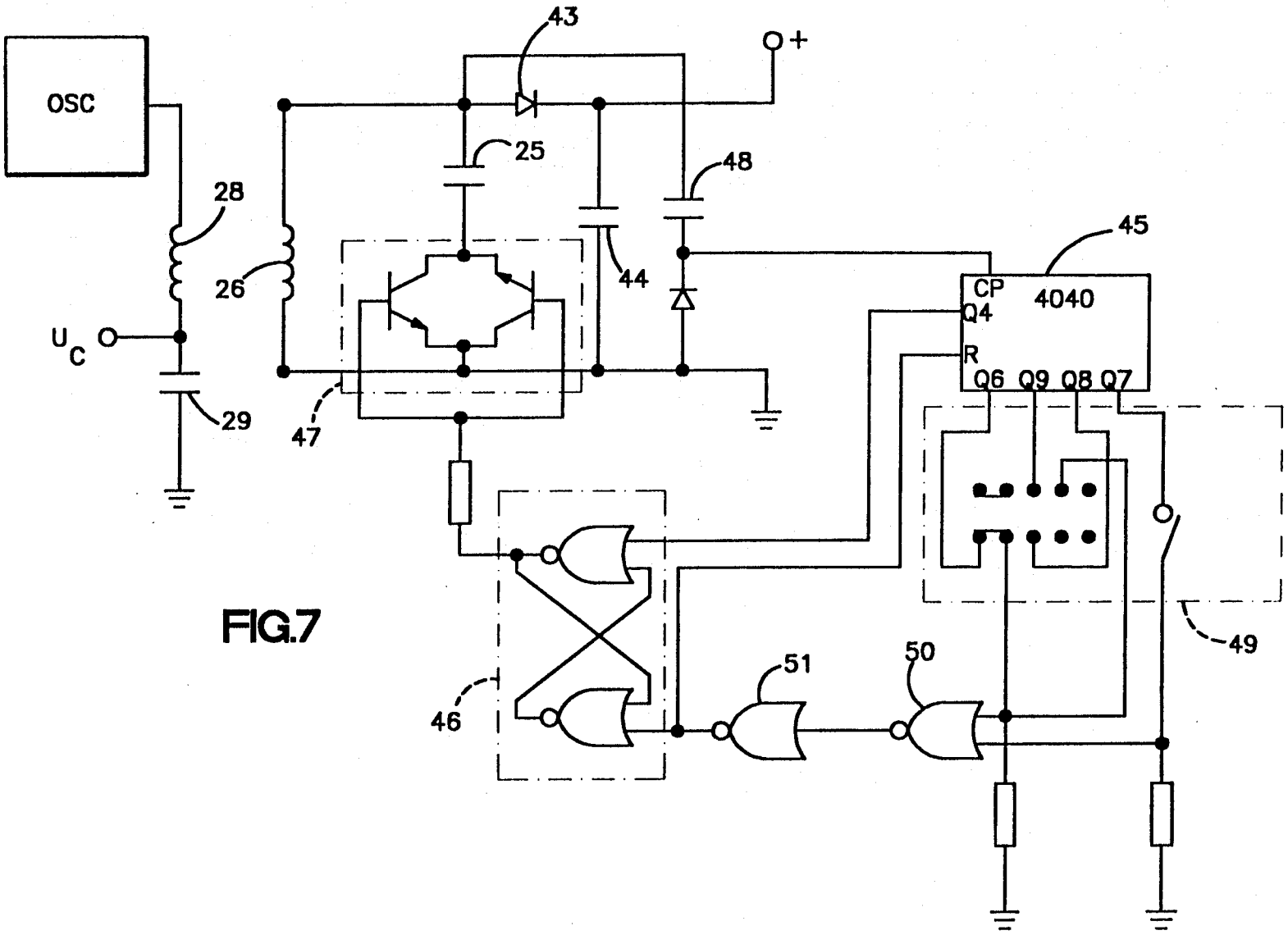
FIG. 7 is a circuit diagram for a practical embodiment of the secondary circuit.

FIG. 8, finally, is a timing diagram of voltage waveforms appearing in the circuit of FIG. 7.

Figure 1:
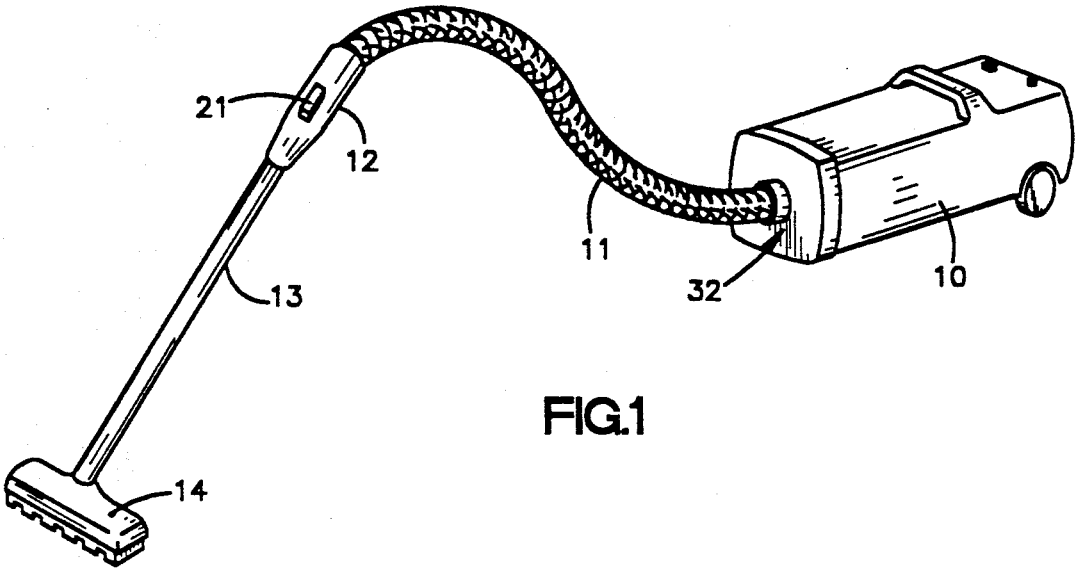
Figure 2:
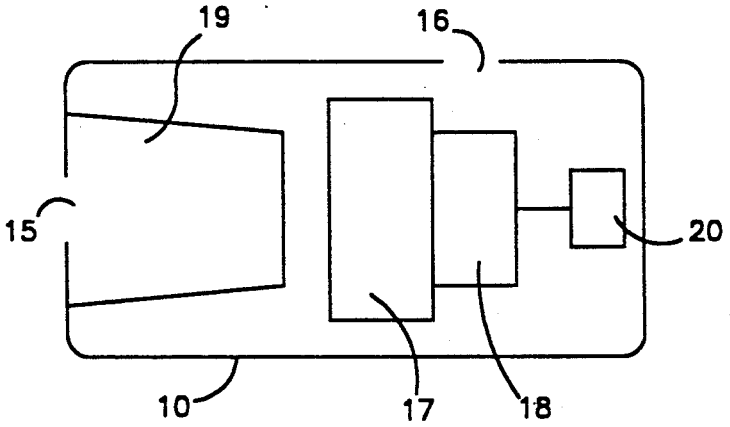
FIG. 2 is a schematic view of the interior of the vacuum cleaner.

FIG. 1 shows a vacuum cleaner 10 of common design. Via a hose 11, having a hose handle 12 and an extension tube 13, the cleaner is connected to a dust collecting nozzle 14. As shown in FIG. 2, the vacuum cleaner is provided with an inlet opening 15 and an outlet opening 16. By a suction fan 17, driven by an electric motor 18, an air stream is established between said inlet and outlet openings. The air stream passes a dust container 19 in which dust, conveyed with the air stream, is kept. An electronic control device 20 is provided in the vacuum cleaner to make possible operation of motor 18 at various speeds. The control device can be operated by an operating member 21, disposed on the hose handle 12 and being, for instance, a slide switch which can be set into four different positions closing four different contacts, as will be described more in detail below.

Figure 3:
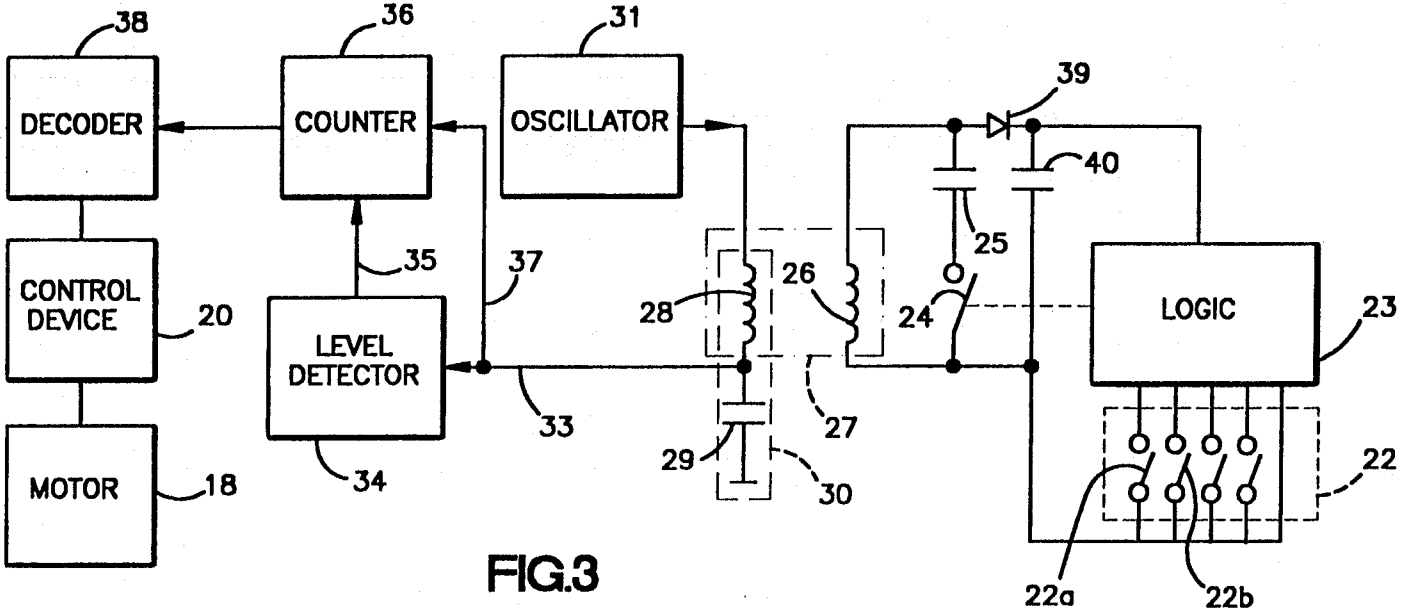
FIG. 3 is a block diagram of a control device for the vacuum cleaner motor, said device being operated from a hose-mounted handle.

The operating member 21 is part of an operating device 22, shown in FIG. 3. By sliding of the operating member the desired contact can be closed. The operating device is interconnected with a logic arrangement 23 which co-operates with a contact 24 in series with a capacitor, connected in parallel with a secondary coil 26 of an air transformer 27. The primary coil 28 of the transformer is connected in series with a capacitor 29 forming therewith a series resonant circuit 30 supplied from an oscillator 31. The primary coil is disposed in the vacuum cleaner and the secondary coil is disposed in the hose at the end connecting to the vacuum cleaner, indicated in FIG. 1 by arrow 32. Via a conductor 33, the connecting point between the coil 28 and the capacitor 29 is connected to a level detector 34, the function of which will be described below. Via a conductor 35, the level detector is connected to a counter 36 which is also, via a conductor 37, connected to the conductor 33. The counter is connected to a decoder 38 which in turn is connected to the control device 20 for the motor 18. The oscillator 31, detector 34, counter 36 and decoder 38 in the primary circuit combine to form a conversion means or device which develops a signal to the control device 20 to control motor operating mode or operating speed.

In the circuit shown in FIG. 3 the oscillator 31 feeds the series resonant circuit, comprising the primary coil 28 and the capacitor 29, at a frequency maximizing the current in said circuit. In the usual way, a voltage is induced in the secondary coil 26, said voltage being used also for powering of the logic arrangement 23. To this end, a smoothed DC voltage is generated by a diode 39 and a smoothing capacitor 40.

Figure 4:
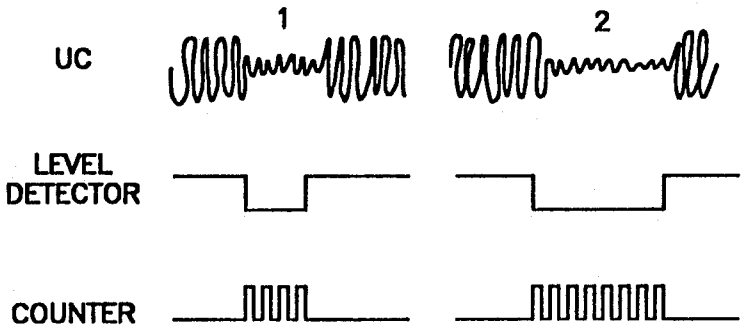
FIG. 4 is a timing diagram showing voltages and waveforms appearing in the control device of FIG. 3.

As long as no contact in the operating device 22 is closed, the secondary circuit will not load the primary circuit and the voltage across the capacitor 29, called $U_c$, will take a high level and have the appearance shown at the top of FIG. 4.

However, if one of the contacts say 22*a*, is closed, contact 24 will be closed connecting capacitor 25 in parallel with the coil 26. Thereby, also at the secondary side a resonant circuit will be formed causing the secondary circuit to more heavily load the primary circuit which results in that the voltage $U_c$ decreases to a lower level. This condition remains during a time period $T_1$ (FIG. 4) set by a timer in the logic arrangement and indicating the closing of the contact 22*a*. When the time $T_1$ has lapsed, the logic arrangement 23 opens the contact 24, again establishing the original condition in the secondary circuit.

Upon the decrease of the capacitor voltage $U_c$ the level detector 34 is again activated operating the counter to start counting. When, after the period $T_1$, the level is again increased, the level detector is again activated stopping the counter. The count corresponds to the time $T_1$ and is decoded in the decoder 38 emitting an output voltage depending on the count and thereby indicating the closing of contact 22*a*.

In an analog way the closing of the contact 22*b* is indicated by the logic arrangement 23 keeping the contact 24 closed during a longer time $T_2$, for instance amounting to $2 \times T_1$. Here, the counter 36 has time to count twice as many pulses as in the first-mentioned case and the corresponding output voltage from the decoder 38 will be correspondingly higher. Here, it is easy to design the circuits so as to have easily distinguishable voltage levels appear on the output of the decoder.

Figure 5:
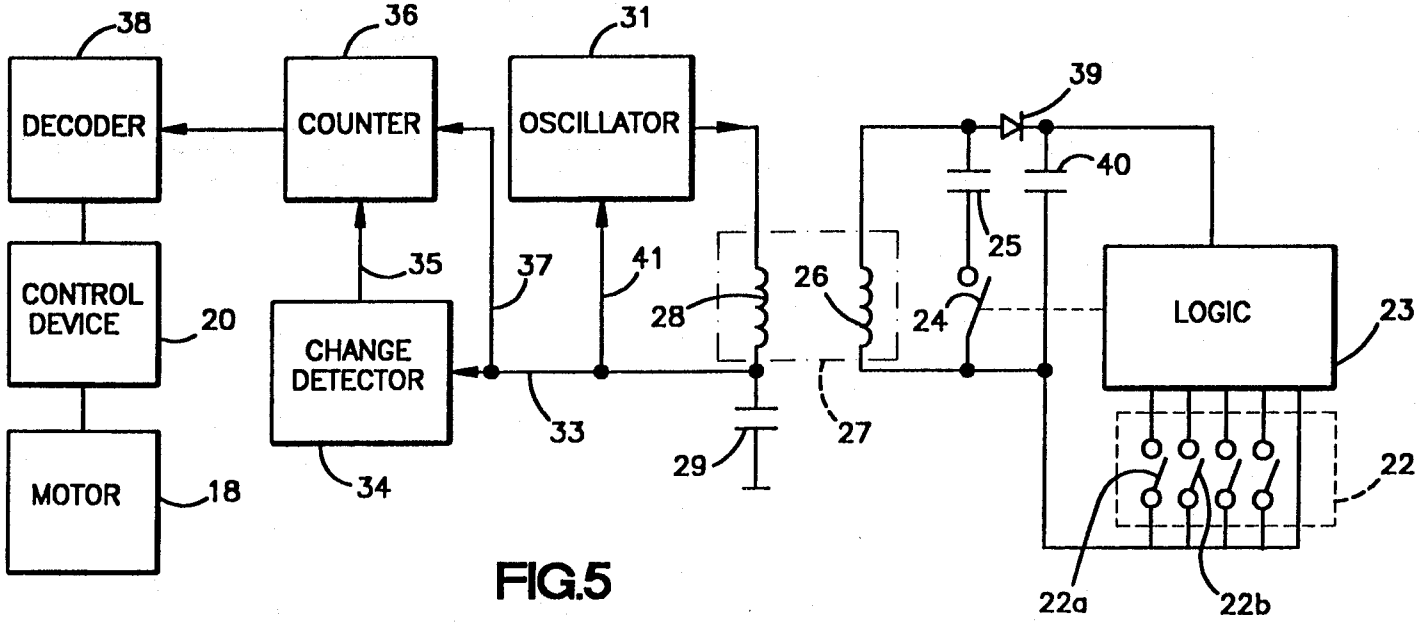
FIG. 5 is a block diagram of a modification of the control device of FIG. 3.
Figure 6:
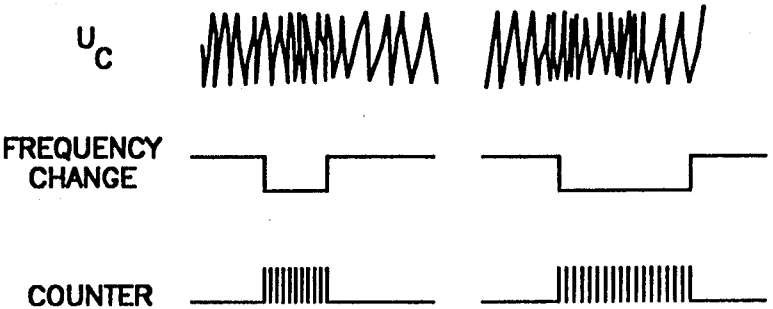
FIG. 6 is a timing diagram for voltages and waveforms appearing in the circuit shown in FIG. 5.

An alternative embodiment is shown in FIG. 5 and is being described also with reference to FIG. 6. The circuit is the same as in FIG. 3, however, differing in that, via a conductor 41, the oscillator has a feed-back loop from the connecting point between the primary coil 28 and the capacitor 29. This feed-back causes the frequency of the oscillator to depend on the condition in the secondary circuit. In FIG. 6, at the top, the voltage $U_c$ across the capacitor 29 has been given a mainly constant amplitude. This is not completely correct but has been done to indicate that here the frequency of the oscillator is of interest and not the voltage level. Said frequency can take two different values determined by the condition of the secondary circuit. The frequency is lower during periods in which no contact is closed in the operating device 22 and, hence, nor is contact 24. On the contrary, the frequency increases to a higher value as soon as any contact in the operating device is being closed, thereby causing the closure of the contact 24. Here, a frequency change detector 42 replaces the level detector 34 in FIG. 3. As appears from the middle diagram in FIG. 6, detector 42 indicates when the frequency changes from a lower to a higher value, thereby emitting a pulse starting the counter 36. The counter counts the pulses appearing on the conductor 37 and the counting continues until the detector 42 indicates that the frequency again changes to the lower value. This change corresponds to a change in the condition of the secondary circuit caused by the opening of contact 24. The detector 42 determines a first time $T_3$ corresponding to the closing of the contact 22*a*. Here, the frequency is higher than during the time of operation of the counter and, therefore, the number of pulses for each contact is higher than in the embodiment of FIG. 3, resulting in an improved distinguishing capability of the conversion device. In an analog way, the closure of the contact 22*b* causes the counter to be activated during the time $T_4$ which is twice as long as $T_3$. The number of counted pulses will increase correspondingly.

In FIG. 7 a practical design of the secondary circuit is shown. As indicated above, the electronic components mounted in this circuit are powered from the oscillator 31 of the primary circuit. If it is of interest to detect level, as in the embodiment of FIG. 3, this means that during periods of low level, when the counter 36 is to operate, the oscillator is heavily loaded which cannot continue during any longer time if the oscillator is to operate safely. The circuit shown in FIG. 6 remedies this drawback by ensuring that during periods of activated counter the secondary circuit does not load the oscillator, i.e. the voltage $U_c$ across the capacitor 29 (FIG. 3) has a high level.

In the practical circuit of FIG. 7 powering takes place via the secondary coil 26, a diode 43 and a smoothing capacitor 44 in the same way as described above in connection with FIG. 3. Here, the logic arrangement is constituted by a counter 45 co-operating with a flip-flop 46. The contact 24 of FIG. 3 here takes the shape of a transistor switch 47 for AC, compare TRIAC, connected in series with a capacitor 25 (the same reference numeral as in FIG. 3). The counter 45, being of the type 4040, receives clock pulses which are derived from the oscillator voltage and which are led, via a capacitor 48, to the clock pulse input CP. The counter has an output Q4, a RESET input R and a number of outputs connected to an operating device 49 equipped with contacts.

The circuit of FIG. 7 will now be described with reference also to FIG. 8. The principle of this circuit is that the oscillator be loaded during short periods of time only as compared to the total time during which the detection of the setting of the operating device 49 takes place. In this way, it is ensured that the oscillator of the primary circuit is not unneccessarily disturbed while at the same time the supply voltage of the secondary circuit is maintained, causing the electronic components of this circuit to operate in a faultless manner. The counter 45 permanently receives clock pulses on the input CP. Now, when a contact in the operating device 49 is actuated, via an OR-gate 50 and an inverter 51 a high level is created on the RESET-input R of the counter which is being reset and then starts to count-up.

The high level on the output of the inverter 51 is also led to the SET-input S of the flip-flop 46 setting the flip-flop, which causes the transistor switch 47 to close connecting the capacitor 25 in parallel with the secondary coil 26. In FIG. 8, at the top, a diagram is shown of the capacitor voltage $U_c$ (FIG. 3) and the low level corresponds to the loader condition of the secondary circuit, just described. After the lapse of a predetermined number of pulses, corresponding to the time T00 of FIG. 8, the output Q4 of counter 45 is activated causing a high level to be applied to a RESET-input R of flip-flop 46. The flip-flop is reset causing the transistor switch 47 to open and to disconnect the capacitor 25. Thereby, the voltage $U_c$ rises to the high level at which it remains during the continued counting-up of the counter to, in proper order, activate the outputs Q6–Q9, connected to the operating device 49, in order to detect the closing of any contact. In FIG. 8 the first time T01 corresponds to a first contact being closed. The time T01 corresponds to the time from the activation of the output Q4 and to the activation of the output corresponding to said first contact. Upon the activation of the output, the counter 45 is reset in the way described via the gate 50 and the inverter 51. Then, the counter restarts with a period of low level until again the output Q4 has been activated. In FIG. 8 the closing of a second contact in the operating device corresponds to the time T02, twice as long as the time T01, while a third contact corresponds to the time T03 which is twice the time T02. The times T01, T02, T03 etc. are thus separated by the time T00 representing periods of the same duration and of low level.

We claim:

1. An arrangement in a vacuum cleaner (10) of the kind connected to a dust collecting nozzle (14) via a hose (11) having a hose handle (12), the vacuum cleaner (10) having a suction fan (17), driven by an electric motor (18), and an electric control device (20) for controlling motor speed for different operating modes, the control device (20) being manually operated by an operating member (21) having a plurality of operating mode settings, the operating member being mechanically connected to an operating device (22) having a plurality of electrical contacts, each of said electrical contacts corresponding to an operating mode setting, the operating device being electrically connected to the control device (20) via two coils, magnetically coupled to each other, of which a primary coil (28) in a primary circuit is disposed in the vacuum cleaner and a secondary coil (26) is disposed in the hose, conversion means (31,34,36,38) disposed in said vacuum cleaner, being provided to detect different electrical states of a secondary circuit (25,26) having as a part said secondary coil (26), said different electrical states being caused by the operating device, characterized in that the operating device (22) is connected through a logic means (23) to cause the secondary circuit (25,26) to take one of two different electrical states depending on the operating mode setting of the operating member (21), to keep the secondary circuit (25,26) in one of the said states during a time period depending on the operating mode set.

2. An arrangement according to claim 1, characterized in that the conversion means (31,34,36,38) comprises an oscillator (31) for the supply of a series resonant circuit consisting of the primary coil (28) and a capacitor (29).

3. An arrangement according to claim 1 or claim 2, characterized in that the secondary coil (26) is connected in series with a capacitor (25) and a contact (24), which is controlled by the logic means (23), the series resonant circuit, consisting of the coil (26) and the capacitor (25), being tuned to the frequency of the oscillator.

4. An arrangement according to claim 3, characterized in that the logic means (23) is a logic arrangement provided with a number of inputs to which a corresponding number of contacts (22*a*,22*b*) is connected, the logic arrangement comprising a settable timer unit and, upon any of said contacts being activated by said operating member, the logic arrangement is arranged to close a contact (24) connected in series with the secondary coil (26) during a time period determined by the timer unit and corresponding to the selected operating contact (22*a*,22*b*).

5. An arrangement according to claim 2, characterized in that the conversion means (31,34,36,38) is arranged to generate a sequence of pulses for which the number of pulses corresponds to the time during which the secondary circuit (25,26) is kept in said one of said states.

6. An arrangement according to claim 5, characterized in that the conversion means includes a counter (36) for counting a sequence of pulses, and a level detector (34) for determining the time during which the sequence of pulses is supplied to the counter (36) by detecting the changes of voltage appearing at the setting and resetting, respectively, of the said state in the secondary circuit (25,26).

7. An arrangement according to claim 6, characterized in that, at a constant periodicity and for periods of short duration, the logic means (23) is arranged to operate the secondary circuit (25,26) to take a state causing a low level for the voltage appearing across the capacitor (29) of the primary circuit, while, upon the operating device (22) being activated by said operating member (21), said logic means (23) is arranged to operate the secondary circuit (25,26) to take the other state, causing a high level for said voltage during the time determined by the operating device (22) and dependent on the setting of the operating member.

8. An arrangement according to claim 5, characterized in that the oscillator (31) is arranged to operate at two different frequencies, corresponding to the two states of the secondary circuit (25,26), the conversion means (31,34,36,38) comprising a counter (36) for counting the sequence of pulses, and a frequency change detector (42) for determining the time during which the sequence of pulses is supplied to the counter (36) by detecting the frequency changes appearing at the setting and resetting, respectively, of the said state in the secondary circuit (25,26).

9. An arrangement according to claim 2, characterized in that the secondary circuit (25,26) comprises means (39,40) provided for the powering of the operating device (22) and the logic means (23) from the oscillator (31) included in the primary circuit.

* * * * *